United States Patent [19]

Sauder et al.

[11] 3,940,244

[45] Feb. 24, 1976

[54] CERAMIC FIBER INSULATION MODULE

[75] Inventors: Robert A. Sauder; Gary R. Kendrick; Dale Rich, all of Emporia, Kans.

[73] Assignee: Sauder Industries, Inc., Emporia, Kans.

[22] Filed: Sept. 19, 1974

[21] Appl. No.: 507,484

[52] U.S. Cl. ..... 432/247; 110/1 A; 432/252

[51] Int. Cl.[2] ..... F27D 1/00

[58] Field of Search ..... 432/247, 252; 110/1 A

[56] References Cited

UNITED STATES PATENTS

| | | | |
|---|---|---|---|
| 1,837,146 | 12/1931 | Brooks | 432/247 |
| 2,389,622 | 11/1945 | Hensel | 110/1 A |
| 3,771,467 | 11/1973 | Sweet | 110/1 A |
| 3,832,815 | 9/1974 | Balaz et al. | 110/1 A |
| 3,854,262 | 12/1974 | Brady | 110/1 A |

*Primary Examiner*—John J. Camby

*Attorney, Agent, or Firm*—Arnold, White & Durkee

[57] ABSTRACT

A novel insulation module for lining the interior surfaces of high temperature chambers such as furnaces, is described. The module comprises in its basic form a first block of high temperature insulating material and a second block overlying the first block but rotated 90° with respect thereto. Each of these blocks is formed from a mass of ceramic fibers, all of which are oriented generally in planes substantially perpendicular to the surface of the furnace wall.

7 Claims, 12 Drawing Figures

FIG. 1
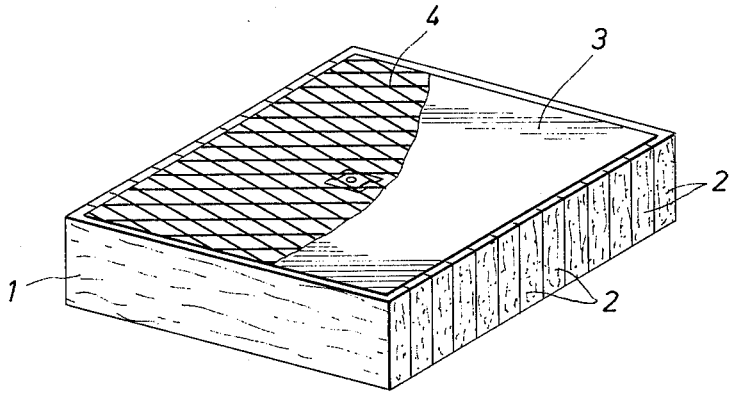
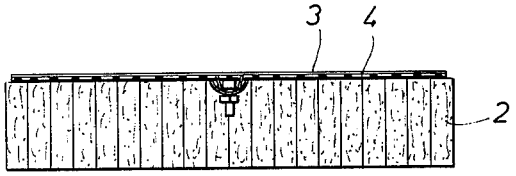
FIG. 2
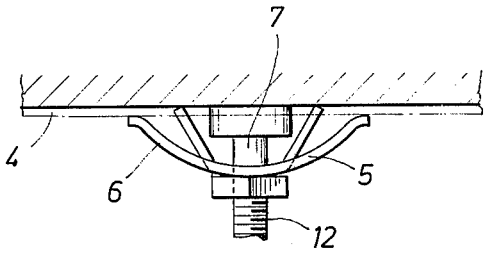
FIG. 3
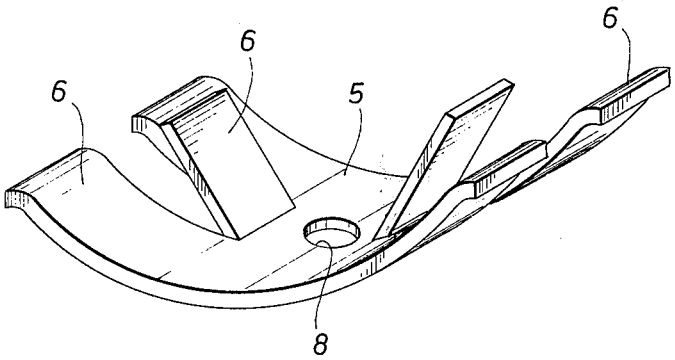
FIG. 4
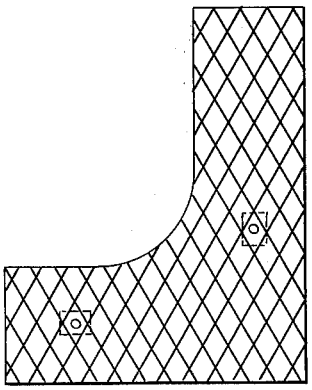
FIG. 7

FIG. 5
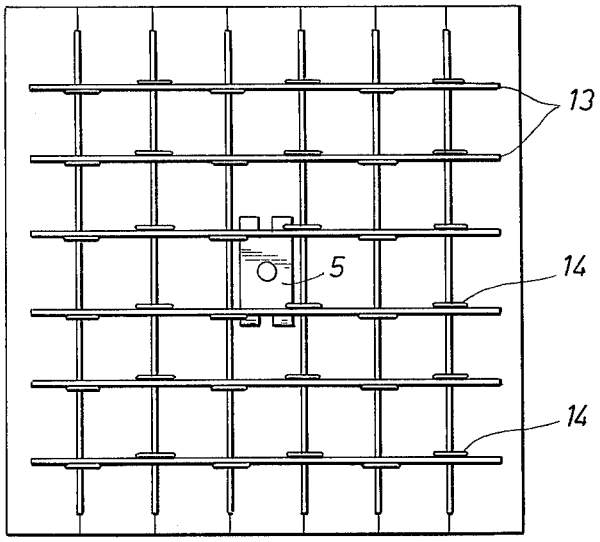
FIG. 6
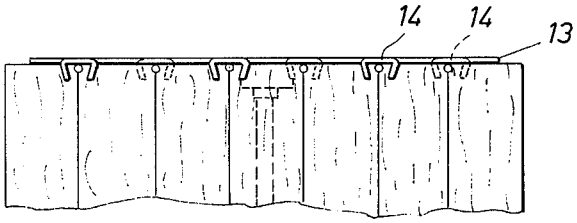
FIG. 11
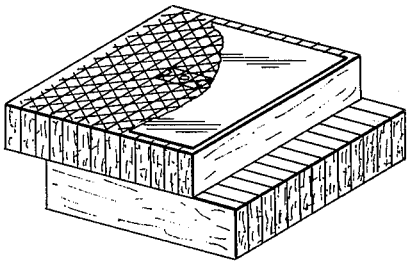
FIG. 8
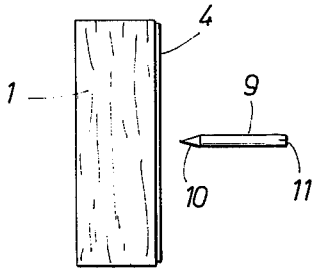
FIG. 9
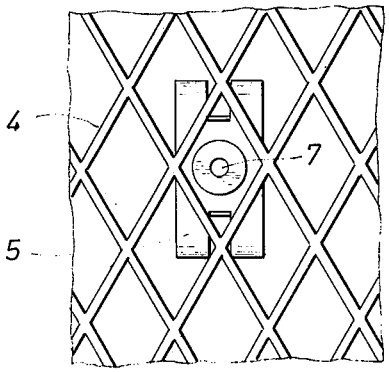
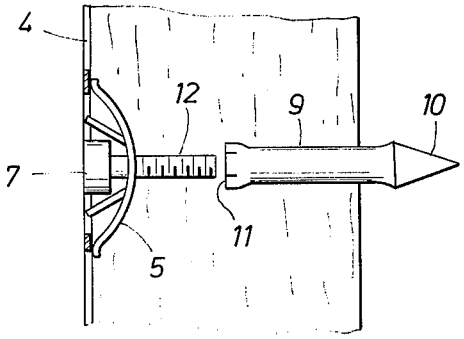
FIG. 10

CERAMIC FIBER INSULATION MODULE

CROSS-REFERENCE TO RELATED APPLICATIONS

This application briefly describes, but does not claim, a method and apparatus for welding which is more fully described and claimed in U.S. Pat. No. 3,706,870 issued Dec. 19, 1972, in the names of the inventors Robert A. Sauder and Gary R. Kendrick and entitled "Method and Apparatus for Stud Welding."

In addition, the subject matter of this application is related to U.S. Pat. No. 3,819,468 issued June 25, 1974, in the names of the inventors herein and entitled "High Temperature Insulating Module."

Moreover, the subject matter of this application is related to copending U.S. Patent application Ser. No. 445,807 filed Feb. 25, 1974, a Division of Ser. No. 157,433, filed June 28, 1971, now U.S. Pat. No. 3,819,468 in the names of the inventors Robert A. Sauder and Gary R. Kendrick and entitled "High Temperature Insulation Module."

BACKGROUND OF THE INVENTION

In U.S. Pat. No. 3,819,468, granted on June 29, 1974, there is disclosed a novel form of construction for a high temperature insulation module wherein the outer surface of the module consists of a mat of resilient ceramic fibers formed by combining in side-by-side relation thin strips cut from standard blankets of ceramic fiber insulation such that the fibers are oriented generally in planes substantially perpendicular to the hot face of the insulation module. The module was especially adapted to be fastened to the interior surfaces of a high temperature chamber, such as a furnace, by means of a unique method of stud welding, also disclosed in the above-mentioned application and more fully described in U.S. Pat. No. 3,706,870, issued Dec. 19, 1972.

This novel module construction eliminated to a large extent the tendency for the insulation material to crack and thereby lose effectiveness as a result of exposure to the continued cycles of heat-up and cool-down experienced in high temperature furnaces. Furthermore, the unique aspect of the insulation module construction, that is, with the ceramic fibers disposed generally perpendicular to the surface of the furnace wall, essentially eliminated a second problem previously encountered with the use of ceramic fiber insulation, that of devitrification and delamination of the outer surfaces of the insulation material. Finally, the ceramic fiber layer of the insulation module disclosed in that earlier application had the property of being resilient and significantly less inclined toward loss of structural integrity.

In the module disclosed in the above first-mentioned patent, the ceramic fiber mat was adapted to overlie an intermediate rigid insulating member positioned between the mat and the interior wall or surface of the high temperature chamber to which the module was to be attached. The primary function of this rigid base member was to give structural strength and rigidity to the final insulation module.

Because of the necessity of providing this rigid base member as part of the insulation module, additional manufacturing operations were involved. This obviously resulted in a higher cost for the module. Further, there were some limitations placed on the shape and size of the modules which would be available without special order. This was due to the fact that the hole for insertion of the stud on which the module would be mounted against the furnace wall was required to be cut through the rigid base member during the manufacturing operation.

Development has been directed toward manufacturing these modules at lower cost. While more efficient methods and apparatus for constructing such modules have been developed, there remains, nevertheless, a strong need for an effective insulation module which can be manufactured and installed at lower cost.

BRIEF SUMMARY OF THE INVENTION

The present invention is the result of the unexpected discovery that when a plurality of strips cut from standard ceramic fiber insulation blankets are secured in side-by-side relation so as to form a singular insulation mat of suitable thickness having the fibers generally oriented in planes perpendicular to the surface of the insulation mat and then two such mats are attached one on top of the other, the resultant mat has a rather significant degree of structural strength and rigidity. Thus, it was found that for many purposes a satisfactory insulation module could be constructed without the additional thickness of rigid refractory material as an essential element. The present invention provides a novel high temperature insulation module wherein the insulation medium consists solely of a pair of overlying mats of ceramic fiber insulation the fibers of which are oriented generally in planes substantially perpendicular to the hot face of the module.

The necessary requirement of a backing for fastening the instant modules to the furnace surface is satisfied by adhering the insulation block to a thin support sheet or plate of metal or some other suitable material. The insulation module resulting therefrom is thus lighter and more cheaply manufactured than the module having a rigid block of refractory material as an integral part thereof.

Additionally, the present invention has many on-the-site installation advantages. For example, when the backing sheet of the module is a material such as expanded metal, having openings throughout, the support studs may be inserted into the module during the installation process on the field site. Thus, further substantial reductions in the manufacturing process and flexibility in the installation process have been realized.

BRIEF DESCRIPTION OF THE DRAWINGS

FIG. 1 is a semidiagrammatic illustration of a mat made according to the present invention. An expanded metal support backing is illustrated, the backing being partially cut away;

FIG. 2 is an elevation cross section of the mat shown in FIG. 1, illustrating in section the construction of the preferred means of fastening to be employed in attaching the module to the furnace wall;

FIG. 3 is an elevation view, on a larger scale, of the preferred means of fastening;

FIG. 4 is a further enlarged and isometric detail of the "washer" employed in the preferred method of fastening;

FIG. 5 is a plan view of the back surface of the module, illustrating a welded wire embodiment of the metal support backing;

FIG. 6 is a cut away cross section of the embodiment shown in FIG. 5, illustrating the method of adhering the welded wire backing sheet to the ceramic fiber mat;

FIG. 7 is a plan view of a module with an expanded metal backing and having been cut to a special shape, there further being illustrated the flexibility in location of the stud fastener;

FIGS. 8, 9, and 10 relate to a preferred method of on-the-site installation of the preferred means of fastening where an expanded metal backing sheet is employed in the module.

FIG. 8 is a side elevation view showing a tube and nut assembly with insertion dart attached;

FIG. 9 is an enlarged view of the area at the expanded metal backing where the preferred stud fastener is located;

FIG. 10 is a cut away side elevation view of the embodiment shown in FIG. 9, showing the relationship of the various parts subsequent to insertion and prior to the stud welding operation.

FIGS. 11 and 11*a* are perspectives of modules according to the present invention wherein the ceramic fiber insulation block is formed by adhering two mats of insulation material to each other, said mats being offset in such a manner that the seams between the modules are overlapped.

DESCRIPTION OF THE INVENTION

Figure 11A:
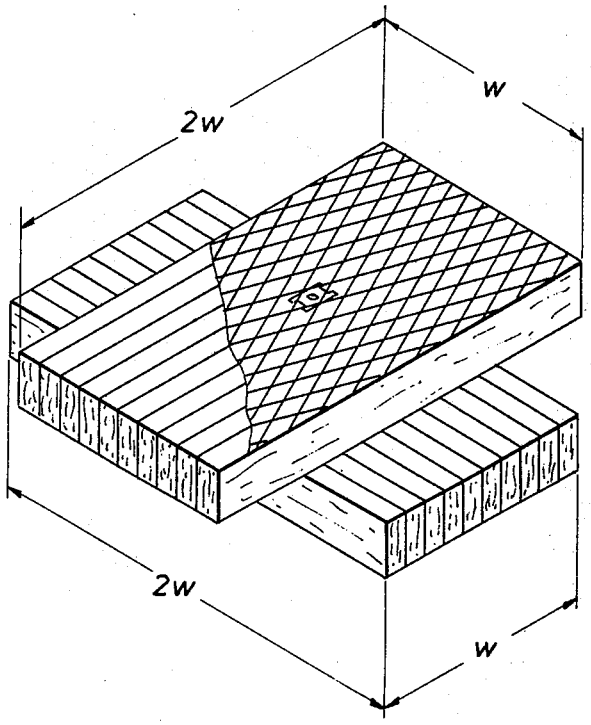

According to the present invention, there is provided a novel insulation module for lining the interior surfaces of high temperature furnaces. The module consists in its basic form of a first flat block or mat of insulating refractory material, with a thin plate or sheet of backing adhered thereto for fastening the insulating block to the furnace wall. A second flat block is attached to the hot face of the first block. The hot face of the insulating module, to be exposed to the furnace heat, is the surface formed by the outer edges of a mass of ceramic fibers of the second block, all of which are oriented generally in planes substantially perpendicular to the surface of the furnace wall. The mass of ceramic fibers so oriented forms a resilient mat of insulation comprising essentially the entire insulating medium of the novel insulation module.

While ceramic fiber insulation has been used in the past as thermal insulation, such use has been limited to blankets of the fiber insulation wherein the fibers are oriented generally in planes parallel to the surface upon which the heat impinges. In high temperature applications, that is, those in the order of 1,600° to 2,600° F. or higher, such blankets alone do not have the structural integrity and resistance to cracking due to heat shrinkage necessary for a practicable insulation. Even when a thickness of rigid refractory material such as an asbestos block is employed as a support medium for the blanket of ceramic fiber insulation, the fiber rapidly losses its structural integrity due to devitrification and delamination, cracks open due to heat shrinkage and heat is therefore transmitted to the outer surface of the furnace shell. Only when the thickness of ceramic fiber insulation forming the module hot face is formed by disposing the fibers in planes substantially perpendicular to the direction of the impinging heat are these problems significantly lessened.

Prior to the present invention, however, it was assumed that, even when using a thickness of ceramic fiber insulation wherein the fibers are oriented in perpendicular planes, it was still necessary to provide a thickness of rigid refractory material in an insulation module for adequate structural rigidity and strength. It has now been discovered that ceramic fiber insulation modules of this type can be formed having sufficient integrity, strength and resistance to heat shrinkage and loss of structural rigidity due to devitrification that a thickness of a second, rigid insulating material, is not necessary. This is accomplished, according to the present invention, by combining two overlying mats fabricated from thin strips cut from a typical ceramic fiber insulation blanket, with the strips so disposed as to orient the ceramic fibers in planes substantially perpendicular to the surface of the insulation batting, to form a single insulation module.

With reference to the accompanying drawings, a mat of an insulation mat according to the present invention is illustrated in FIG. 1. As seen, the module 1 comprises a flat block of insulation formed by combining a plurality of strips 2 of ceramic fiber insulation disposed in side-by-side relationship in such manner that the fibers are oriented in planes generally perpendicular to the opposed larger surfaces of the flat block so formed. These strips of ceramic fibers are cut transversely from a length of ceramic fiber blanketing which is commercially available. These blankets are manufactured by several different manufacturers and sold under the trademarks or tradenames "KAOWOOL" (Babcock & Wilcox), "LO-CON" (Carborundum Co.), "CERAFELT" (Johns Manville Corp.), and "FIBERFRAX" (Carborundum Co.). The strips are cut from the fiber blanket in widths determined by the desired final thickness of the insulation module. It has been found that with presently available fibers the best combination of high temperature refractoriness and self-supporting structural rigidity results from thicknesses of from 2 to 12 inches. The strips are placed on edge and laid lengthwise adjacent each other with a sufficient number of strips being employed to form a mat of the desired width. Naturally the thickness of the fiber blanket from which the strips are cut will determine the number of strips required to construct the mat. Those strips may be fastened together by wire, ceramic cement or mortar, which is preferably employed in the region of the cold face of the mat to be formed. The manner of forming the insulation mats is more fully disclosed in copending application Ser. No. 157,433, herein incorporated by reference and not forming a part of this invention.

In FIG. 1, the strips are shown adhered to a sheet of backing paper 3. This paper is only used during the manufacturing process and generally burns away in use in a furnace. Over the block of ceramic fiber insulation thus formed is placed a thin sheet or plate of backing material 4, preferably metal or some other rigid material which would withstand the necessary temperatures and provide adequate support to hold the module together and against the furnace wall. More preferably yet, the backing substrate consists of a perforate metal structure such as welded wires, expanded metal or the like, which has at least one opening through which may be inserted a fastening stud assembly or some other suitable means by which the block may be affixed to the furnace wall. FIG. 1 shows a partially cut away backing plate formed of expanded metal. This metal backing plate 4 may be adhered to the block of ceramic fiber insulation by any suitable means, such as ceramic mortar.

It is contemplated that during the manufacturing process a small hole will be punched in the backing paper 3 to which the block of ceramic fiber insulation is adhered. This hole will be visible through the expanded metal support sheet and will provide a convenient means of locating the center of the block for insertion of a fastening stud or any other means by which the block may be attached to the furnace wall in the field.

Illustrated in FIGS. 1–4 is a preferred means of facilitating stud placement in field operations. This means and the method of carrying it out (as further illustrated in FIGS. 8–10) are described as follows:

The metal piece 5 illustrated in detail in FIG. 4, which we prefer to call a "washer", is shaped in a generally arcuate manner, so as to be fitted (on an angle if necessary) through the gaps in the expanded metal backing and further shaped so that end prongs 6 will lock into place onto one "diamond" of the expanded metal backing 4. As will be apparent, any location in the expanded metal backing will be acceptable, although for most purposes the central location, adjacent the hole in the paper backing will be preferred. However, where the block must be cut and shaped into a size to fit a peculiar area on the surface to be insulated, it will be apparent that this washer would be placed advantageously at or near the center of gravity or even two washer assemblies used, as shown in FIG. 7.

This washer, in conjunction with the other pieces of stud assembly 7, as illustrated in FIG. 3, provides an effective means of attaching the insulation module to the furnace surface, employing the stud welding technique fully described and claimed in U.S. Pat. No. 3,706,870 issued Dec. 19, 1972, and also referred to in the above-mentioned copending application. FIG. 3 shows the stud assembly 7, as it would appear when attached to the furnace wall.

Prior to locking the washer 4 into place in the selected diamond location in the expanded metal backing, tube and nut assembly 9 is inserted through the selected diamond into the ceramic fiber insulation thickness. The dart 10 shown at the tip of tube and nut assembly 9 merely provides a point on the tube and nut assembly so it will easily penetrate into the ceramic fibers. As will be more fully understood with reference to the above-mentioned U.S. Pat. No. 3,706,870, the tip of tube and nut assembly 9 which is adjacent to the dart is flared out slightly to facilitate stud welding. The dart 10 is removable. It may or may not protrude through to the hot face of the insulation module. As shown in FIG. 10 the dart 10 protrudes beyond the hot face of the first mat, and thus facilitates locating the stud once the module is in place on the surface and ready to be attached.

Once the tube and nut assembly is inserted into the ceramic fiber insulation, the washer 5 is inserted and locked in place at the selected diamond location. When this is accomplished, the stud and ceramic ferrule assembly 7 is inserted into the diamond location, the stud 12 being extended through the central hole 8 in the washer 5 and contacting the nut 11, wedged inside tube and nut assembly 9 as further illustrated in FIG. 10. At this point, the module is ready for placement on the furnace surface, the dart 10 is removed from the tube and nut assembly 9, and the stud welding procedure as more fully described in the above referenced patent is carried through. The stud 12 is welded onto the surface of the furnace wall and the nut 11 screwed down onto the stud into the thickness of ceramic fiber insulation. The tube is removed from the nut and taken out of the insulation. The fibers are then closed over the nut and stud effectively sealing them from the impinging heat.

A second preferred embodiment of the present invention, enabling utilization of the preferred method of fastening as described above, is illustrated in FIGS. 5 and 6. As seen in FIG. 5, the backing is a standard welded wire mesh 13 adhered to the ceramic fiber mat by steel clinching type staples 14. The washer 5 is then fitted into a span between two lengths of welded wire.

While the preferred embodiments of the invention have been described with reference to a particular means of fastening, that is, the stud welding technique described, it should be understood that any other suitable method of fastening the insulation module to the surface of the furnace will be acceptable. With a solid backing plate, a suitable ceramic mortar applicable at temperatures expected for the cold face of the module may be employed. Alternatively, for the open mesh type of backing plate, an explosive impact type drive pin fastener technique, which is well known to those skilled in this art, will also provide the dual advantages of being accomplished in a single step and of having the fastener hidden within the mat of ceramic fiber insulation after installation. Those skilled in this art will undoubtedly see many further advantages and many equivalent means of fastening the ceramic fiber insulation module to the surfaces of the heating chamber.

The insulation module of this invention is formed by adhering to each other one or more separate layers of ceramic fiber insulation mat formed as described above to form an insulation block of desired final thickness. It should be understood, however, that in order to obtain the full advantages of the present invention, each such separate sheet of ceramic fiber insulation material should be formed with the fibers disposed generally in planes perpendicular to the outer surfaces or faces of the module. Thus, for example, a mat formed with strips cut 2 inches thick, could be adhered to another mat formed from 2 inch strips, resulting in an insulation block 4 inches in total insulation thickness. If desired, opposing layers to be adhered to each other could also be oriented so that the strips would be facing in directions perpendicular to each other. Such a configuration, illustrated in FIGS. 11 and 11*a*, would provide additional structural rigidity to the final module, and overlapped seams between modules.

An additional advantage to providing an insulation thickness consisting of more than one mat of ceramic fiber insulation is that the outer sheet, forming the hot face of the module, may be offset slightly with respect to the remaining thicknesses of insulation in such manner as illustrated in FIG. 11. As shown in FIG. 11, the outer layer of insulation thickness overlies the inner layer or layers of the module which are adjacent to it on the wall surface. Thus, the seam or joint between the adjacent insulation modules, which can serve as a point of insulating weakness, is effectively overlapped and sealed. FIG. 11*a* illustrates a design in which all joints of adjacent insulation modules are overlapped, thus providing further improved joint seals.

As will be apparent, an insulation module formed from a single thickness of ceramic fiber insulation may also be shaped into the offset overlapping form, if desired, by simply cutting a portion of the insulation material from the edges of the module in the appropriate locations.

Shrinkage, as a result of exposure to high temperatures occurs in the longitudinal direction of the individual ceramic fiber strips. Thus it becomes beneficial to provide overlapping in the joints which are perpendicular to the ceramic fiber strips.

Added benefit accrues from overlapping joints which are parallel to the strips as well. This feature is illustrated in FIG. 11*a*.

We claim:

1. An insulation module for lining an interior wall of a high temperature chamber comprising:

a first block of high temperature insulating material, said first block comprising:

a relatively cold face for positioning adjacent the interior wall of the high temperature chamber, and a relatively hot face, opposite said cold face, for exposure to a relatively cold face of a second black of high temperature insulating material; and a second block of high temperature insulating material, said second block comprising:

a relatively cold face for positioning adjacent said relatively hot face of said first block, and a relatively hot face, opposite said cold face of said second block, for exposure to chamber heat;

said first and said second blocks each comprising:

a plurality of strips of resilient fiber insulation positioned adjacent each other in side-by-side relation, the fibers of said resilient strips being arranged in planes substantially perpendicular to the plane of said respective relatively hot faces of said first and said second blocks;

said first and said second blocks being attached together, said strips of said first block being arranged to face in a lateral direction perpendicular to said strips of said second block to provide an insulation module attachable to the interior wall of the high temperature chamber.

2. The insulation module of claim 1 wherein said fibers are randomly oriented in said planes of fibers.

3. The insulation module of claim 1 wherein said first block is offset slightly in at least one direction so as to overlap said second block and, wherein said modules are attachable to the interior wall of the high temperature chamber to overlap a seam between adjacent modules.

4. The insulation module of claim 1 and further comprising a thin, rigid substrate attached to said first block for affixing the module to the wall of the high temperature chamber.

5. The insulation module of claim 4 wherein said thin, rigid substrate is provided with at least one opening through which a fastening stud assembly may be inserted for affixation of the module to the wall of the high temperature chamber.

6. The insulation module of claim 5 wherein said thin, rigid substrate comprises expanded metal and wherein said substrate is attached to said cold face of said first block.

7. The insulation module of claim 5 wherein said thin, rigid substrate comprises a welded wire mesh adhered to said cold face of said first block by steel clinching type staples.

* * * * *